US006250219B1

(12) United States Patent
Garvin

(10) Patent No.: US 6,250,219 B1
(45) Date of Patent: Jun. 26, 2001

(54) SYSTEM FOR APPLYING EMBOSSED PATTERNS ON TEXTURED CEILINGS

(76) Inventor: Glenn Garvin, 1262 Rugby Ave., Ventura, CA (US) 93004

( * ) Notice: Subject to any disclaimer, the term of this patent is extended or adjusted under 35 U.S.C. 154(b) by 0 days.

(21) Appl. No.: 09/370,149

(22) Filed: Aug. 9, 1999

(51) Int. Cl.[7] ..... B05C 17/06
(52) U.S. Cl. ..... 101/129; 101/127
(58) Field of Search ..... 101/128, 128.21, 101/128.4, 129, 127

(56) References Cited

U.S. PATENT DOCUMENTS

| | | | | |
|---|---|---|---|---|
| 2,025,457 | * | 12/1935 | Kavanaugh | 101/128.21 |
| 2,251,647 | * | 8/1941 | Wartha | 101/128.21 |
| 3,929,068 | * | 12/1975 | Rudden | 101/128.21 |
| 4,129,669 | * | 12/1978 | Lopez | 101/128.21 |
| 5,460,087 | * | 10/1995 | Ogorzalek | 101/128.21 |
| 5,816,269 | * | 10/1998 | Mohammed | 132/319 |

* cited by examiner

*Primary Examiner*—Daniel J. Colilla
(74) *Attorney, Agent, or Firm*—J. E. McTaggart

(57) ABSTRACT

For applying embossed patterns on rough-textured surfaces, particularly ceilings, a simple process utilizes readily available inexpensive materials. Portions of a thin plastic sheeting are cut away to form a compliant stencil with the required pattern openings. The compliant stencil is attached temporarily to the textured surface with a non-setting adhesive, applied typically to the compliant stencil but optionally to the textured surface, and is then urged into close compliance with the textured surface by a roller and/or by hand. After applying the setting-type embossing material, typically troweled to a desired thickness, the stencil is removed along with surplus embossing material, leaving the embossing material bonding to the textured surface, cleanly defining the embossed pattern in the regions that were defined by the stencil. Optional preferred preliminary procedures utilize a backing layer to initially support the compliant stencil layer in an undistorted manner until it is adhered in place on the textured surface, to faciliate working with ceilings and/or stencil patterns that are unusually open or complex.

16 Claims, 5 Drawing Sheets

SYSTEM FOR APPLYING EMBOSSED PATTERNS ON TEXTURED CEILINGS

FIELD OF THE INVENTION

The present invention relates to the field of interior/exterior decorating and more particularly it relates to a stencil system and methods for applying a pattern of setting-type embossing material onto a rough-textured surface such as that of a pre-existing ceiling.

BACKGROUND OF THE INVENTION

For enhancing the appearance and architectural merit of walls or ceilings, it is frequently required to add a decorative pattern in selected areas; this is particularly effective when applied to existing rough-textured ceilings of sprayed-on acoustic material.

It has been well known to utilize a stiff stencil, temporarily held against or fastened to the surface, configured with openings that define the regions to be embossed by adding new material, e.g. by spray or trowel, while masking off areas that are not to receive the new material.

There is a particular problem that arises when it is attempted to utilize such a stencil to mask a rough-textured surface: failure of the stencil to conform to the topography of the rough-textured surface introduces random irregularities at the edges of the stencil openings, rendering the edges of the finished embossed pattern rough and fuzzy instead of yielding the desired clean-cut reproduction of the pattern.

The stencil needs to be made compliant enough to be pressed in place to conform closely to the topography of the rough-textured surface, and to remain in close conformity, especially at the edges of the stencil openings, while the embossing material is applied. This requires the stencil material to be highly compliant so that it can stretch and expand as required to conform to the hills and valleys of the texture, but it must be non-elastic to prevent any loss of conformity while applying the embossing material.

Suitable compliant stencil material tends to be excessively flimsy and generally difficult to handle since it is susceptible to stencil damage and/or distorted pattern registration. For satisfactory deployment, special procedures are required particularly if the stencil pattern is unusually open and/or complex, and/or it is to be applied to a ceiling, to which the invention is mainly directed.

DISCUSSION OF RELATED KNOWN ART

U.S. Pat. No. 5,243,905 to Webber discloses a stencil process and system for applying a decorative coating atop a substrate such as horizontal concrete or like surface comprising a plurality of stencils with lock and tab means for interlocking adjacent stencils U.S. Pat. No. 3,853,561 by Reichel discloses a chemical binder process for preparation of screen printing stencils using to intermediate support for light sensitive layer.

U.S. Pat. No. 4,129,699 by Lopez discloses a method of applying decorative designs to surfaces through a stencil comprising a laminated sheet consisting of two layers of waterproof adhesive tapes staggered to cover the seams.

U.S. Pat. No. 5,816,269 to Mohammed discloses a tattoo stencil mechanism wherein a flexible stencil sheet with openings defining the pattern is sandwiched between a backing sheet and a protective carrying sheet. After removal of the backing sheet, the stencil sheet, preloaded with adhesive is adhesively attached to the skin of the subject, then the carrier sheet is peeled off leaving the stencil sheet, through which colored dye is applied to the skin to form a temporary tattoo.

U.S. Pat. No. 3,929,068 to Budden for STENCILS typifies stencil systems of known art that are directed to painting onto smooth surfaces, but that fail to address the special problems of applying embossing material onto a rough-textured surface, and would therefore prove to be excessively non-compliant, and would fail to conform to rough-textured surfaces, and thus would merely demonstrate the very problems which have been addressed and solved by the novel compliant laminated stencil structure taught by the present invention.

OBJECTS OF THE INVENTION

It is a primary object of the present invention to provide a stencil system and related methods for applying setting-type embossing material onto a rough textured surface in a desired decorative pattern.

It is a further object to enable a stencil to conform to the rough-textured surface and to be thusly retained during application of embossing material so as to yield sharp and clean edges in the finished embossed pattern.

It is a further object to provide practicable procedures for satisfactory application of the relatively flimsy compliant to a rough-textured ceiling surface so that it remains closely conformed to the texture surface with the pattern accurately registered without distortion during application of the embossing material, particularly when the pattern is unusually open and/or complex.

It is a further object to provide a stencil structure utilizing material that are common, readily available and inexpensive.

SUMMARY OF THE INVENTION

The above mentioned objects have been accomplished by the present invention of a simple basic stencil system and process utilizing readily available inexpensive materials. The basic steps in the procedure, common to all embodiments, involves deploying a thin plastic sheeting from which portions have been cut away according to the pattern to form a compliant stencil, and arranging for this to be attached temporarily to the textured surface with a non-setting adhesive, where it is urged into close compliance with the topography of the textured surface by a roller and/or by hand. Then after troweling on the setting-type embossing material to a desired thickness, the stencil is removed along with surplus embossing material, and typically discarded, leaving the embossing material bonding to the textured surface, cleanly defining the embossed pattern in the regions that were defined by the stencil.

Optional preparatory procedures are disclosed for overcoming difficulties associated with particular situations such as working with ceilings, and unusual openness and/or complexity of the stencil pattern. A simple pattern with small openings could be cut into the compliant stencil before attachment to a ceiling; however, to avoid distortions in a relatively open and/or complex pattern, the compliant sheet of stencil material can be first applied to the ceiling and then cutting the pattern away with the stencil material adhered to the ceiling, then completing the procedure in the normal manner described.

Generally, in a preferred embodiment, to avoid the difficulty of cutting out complex openings of a stencil pattern on a ceiling, the compliant layer is pre-laminated with a backing layer using a non-setting adhesive. The stencil openings are then cut through both layers or, using a heat cutting process, cut through the compliant layer only. The backing supports the compliant stencil and keeps the pattern in shape during attachment to the ceiling; then, in the normal embossing process, the laminated stencil, with the pattern cut through one or both layers, is rolled/pressed into place into the texture, the backing is removed leaving only the compliant stencil, which can then be urged into even more intimate compliance with the rough texture; then the embossing material is applied and the compliant stencil is removed along with surplus material, leaving the embossed pattern.

When the laminated stencil has the pattern cut out from the compliant layer only (using a heat-cutting process) the cut-out regions can be removed prior to attachment to the ceiling, or these regions can be left in place until after attachment to the ceiling, then removed along with the backing layer before completing the process as described.

This embossing process is particularly beneficial for applying a pattern such as a border to restyle an existing rough-textured ceiling.

BRIEF DESCRIPTION OF THE DRAWINGS

The above and further objects, features and advantages of the present invention will be more fully understood from the following description taken with the accompanying drawings in which:

FIGS. 2A–6B are cross-sectional views showing successive stages in a basic process of making and deploying a compliant stencil to apply the embossed pattern in accordance with the present invention in a basic procedural embodiment.

FIG. 2A shows a ceiling with a rough-textured surface.

FIG. 3 shows the compliant sheet of FIG. 2B adhesively attached to the ceiling of FIG. 2A.

FIG. 4 shows the compliant sheet, as in FIG. 3, made into a compliant stencil by cutting and removing open pattern regions.

FIG. 5 shows the ceiling and attached compliant stencil as in

FIG. 4 with the addition of embossing material troweled in place onto the textured surface in the stencil openings and extending onto the stencil.

FIG. 6B shows the stencil along with surplus embossing material removed from the subject matter of FIG. 5 to yield the finished pattern shown in FIG. 6A.

FIG. 7 shows a compliant layer as in FIG. 2B and a backing layer to which it is to be laminated and then attached to a textured ceiling surface as in FIG. 2A.

FIG. 8 shows the two layers of FIG. 7 attached together adhesively to form a laminate.

FIG. 9 shows the laminate of FIG. 8 with regions cut away to form a laminated stencil.

FIG. 10 shows the laminated stencil of FIG. 9 attached to a textured ceiling.

DETAILED DESCRIPTION

Figure 1:
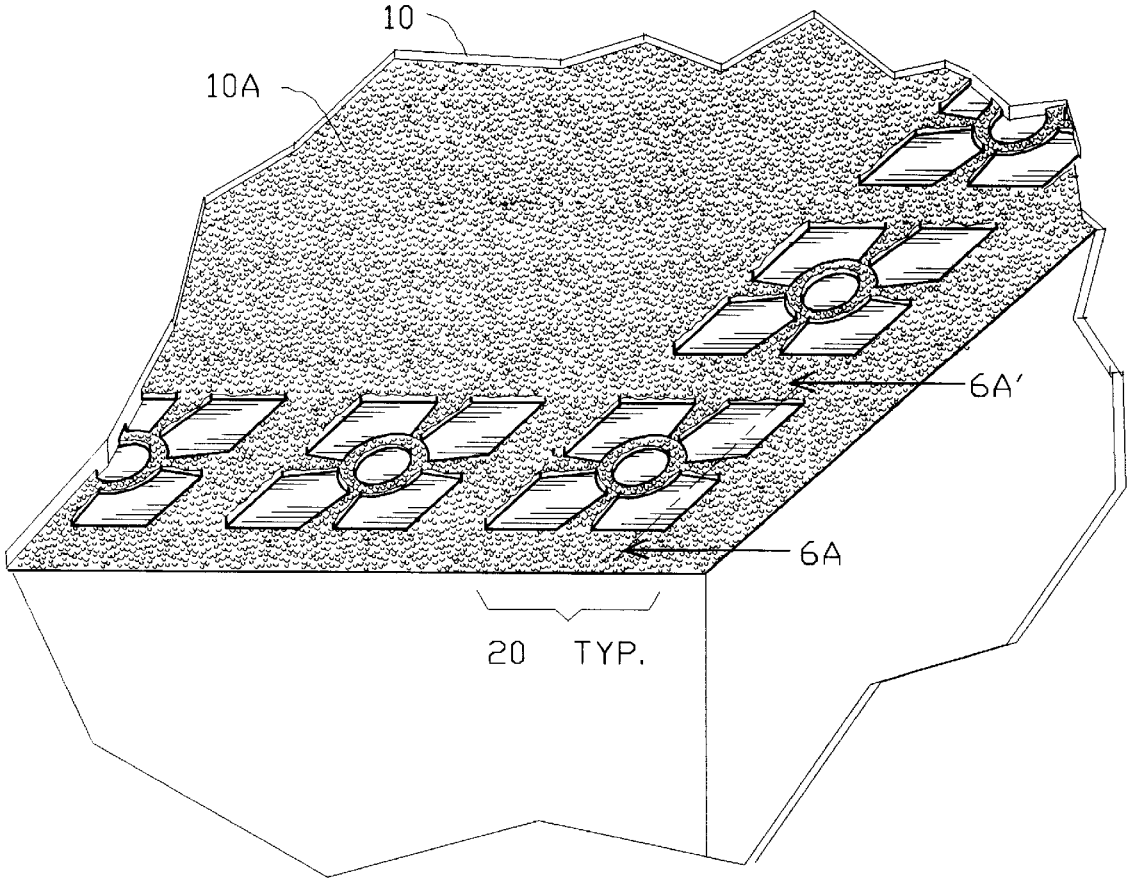
FIG. 1 is a three-dimensional view of a corner portion of a room showing an embossed border pattern applied to a rough-textured ceiling in accordance with the present invention.

FIG. 1 is a three-dimensional view of a corner portion of a room showing recurring square elements 20 of a finished embossed pattern facing downwardly from a rough-textured surface 10A of 35 ceiling 10. This border pattern, which would continue all around the room, is seen in cross-section in FIG. 6A, taken at axis 6A–6A' of FIG. 1. It is to be understood that the pattern shown is an illustrative example; the pattern may made to have any desired shape, size, thickness, fullness and complexity and may be made to cover any desired portion of a wall, ceiling or other surface.

Figure 2A:
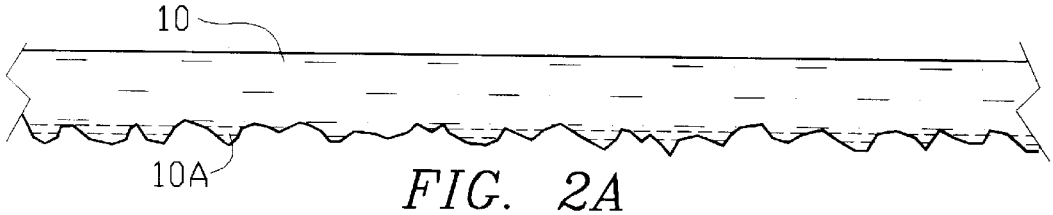

FIG. 2A is a cross-section of a portion of a ceiling 10 with a rough-textured surface 10A, shown prior to application of a decorative embossed pattern as in FIG. 1.

Figure 2B:
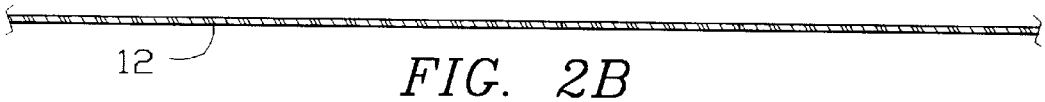
FIG. 2B shows a compliant sheet to be made into a stencil.

FIG. 2B shows a portion of a compliant sheet 12 to be made into a stencil for applying an embossed pattern to the ceiling of FIG. 2A.

Figure 3:
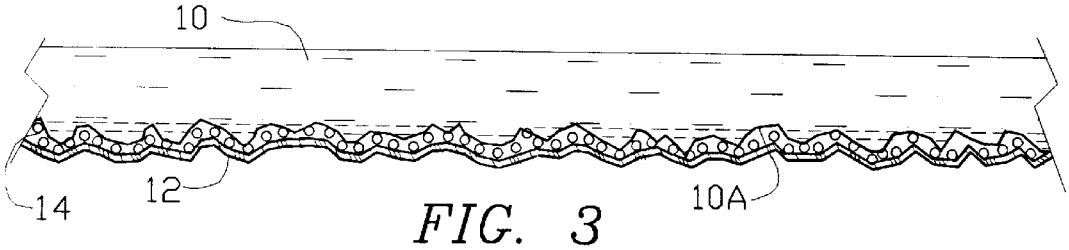

FIG. 3 shows the compliant sheet 12 of FIG. 2B attached to the rough-textured surface 10A of the ceiling 10 of FIG. 2A, typically utilizing a non-setting spray adhesive 14 such as 3M type 77, which may be applied either to sheet 12 or to the textured surface 10A of ceiling 10. Sheet 12 is urged into close conformity with the rough-textured surface 10A using a roller and/or by hand. This requires the material of sheet 12 to be highly compliant so that it can stretch and expand as required to conform to the topography of the texture 10A, but it must be non-elastic to stay in place with no loss of conformity while applying the embossing material. A suitable material for sheet 12 is 0.0004 (0.4 mil) polyethylene sheeting available commercially in various sizes, e.g. a roll 12 by 1200 feet from which suitable working sizes can be cut.

Figure 4:
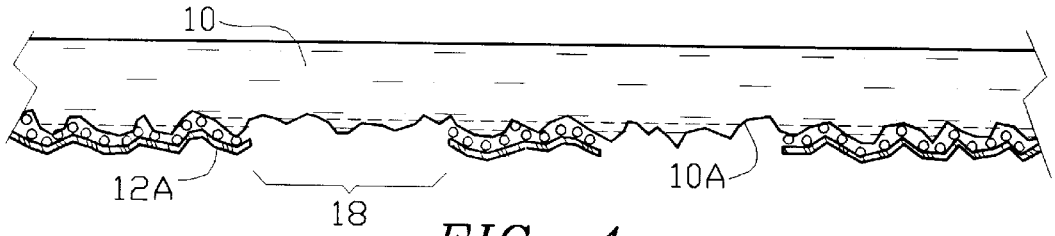

FIG. 4 shows the compliant sheet 12, after attachment to the textured surface 10A of ceiling 10 as in FIG. 3, made into a compliant stencil by cutting and removing the pattern openings 18 with a sharp instrument or heat cutting method, thus exposing the rough-textured surface 10A in the openings 18. At this stage sheet 12 is further rolled and/or hand-pressed to conform with the textured surface 10A, especially around the edges of openings 18, to eliminate any voids.

Figure 5:
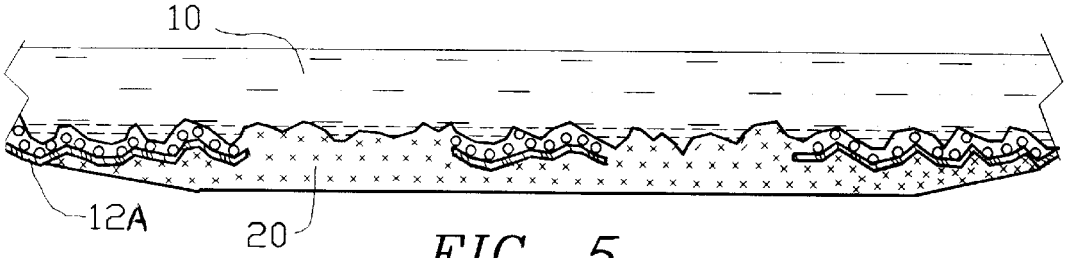

FIG. 5 shows the ceiling 10 and attached stencil 12 as in FIG. 4 with the addition of setting-type embossing material 20, typically a commercial gypsum setting joint compound. This is applied in a conventional manner with a plasterers' taping knife, trowel or similar tool, and troweled to a desired smoothness and thickness, typically 1/16 to 1/8 inch, extending over the stencil openings as well as somewhat beyond the edges of the openings on stencil 12A.

Figure 6A:
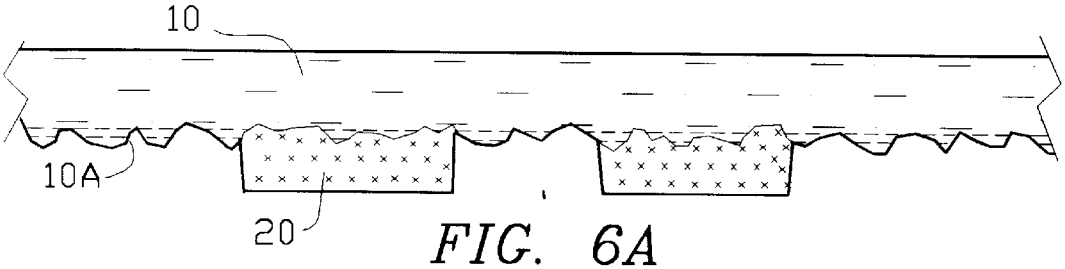
FIG. 6A shows the finished embossed pattern yielded upon removal of the stencil and surplus embossing material from the structural stage shown in FIG. 5.

FIG. 6A shows the finished embossed pattern 20 that is yielded on removing the stencil and surplus embossing material from the structural stage shown in FIG. 5. The added regions of embossing material 20 are cleanly defined from the surrounding original rough-textured surface 10A. Upon removal of the compliant stencil there is a short drying out period for the embossing material 20 to dry out and bond to the textured ceiling surface 10A.

Figure 6B:
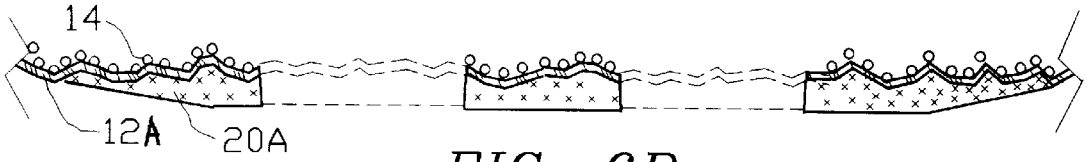

FIG. 6B shows the compliant stencil 12A which has been removed along with surplus embossing material 20A from the structure shown in FIG. 5 to yield the finished embossed pattern shown in FIG. 6A.

FIGS. 7–11 show successive steps in an optional preliminary procedure to facilitate deployment of an unusually open and/or complex stencil pattern, particularly if it is to be applied to a ceiling where cutting out the pattern with the stencil in place can be difficult. The compliant layer is supported by laminating it to a backing layer with a non-setting adhesive, and the stencil pattern is cut prior to attachment to the textured surface. Then the compliant stencil, still supported by the backing layer, is attached to the textured surface, and then the backing is removed, typically using a liquid spray, leaving only the compliant stencil which is then rolled and/or pressed into good compliance with the textured surface, then the embossing material is applied and the procedure is completed in the basic manner of the present invention as described above in connection with FIGS. 4–6B.

Figure 7:
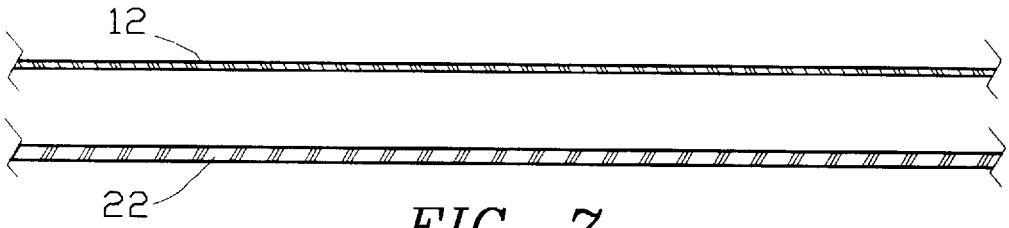
FIGS. 7–10 show successive steps in making a laminated stencil and applying it to a ceiling.

FIG. 7 shows a compliant layer 12 as in FIG. 2B and a backing layer 22 to which it will be laminated for support and then attached to a textured ceiling surface as in FIG. 2A. The backing layer 22 is made of material that is typically somewhat thicker than layer 12 and that is sufficiently firm for the purpose of temporarily supporting the compliant stencil layer 12 until it is attached in place on the textured surface.

Figure 8:
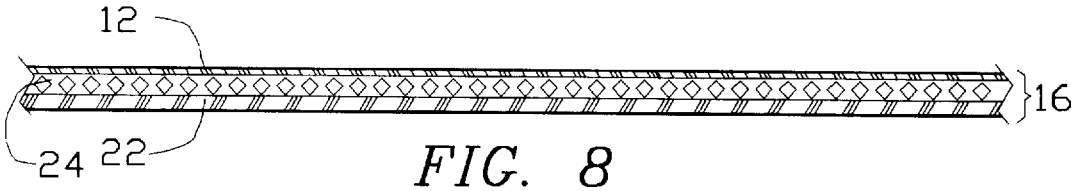

FIG. 8 shows the compliant layer 12 and backing layer 22 of FIG. 7 attached together by a non-setting adhesive 24, which can be a commercial stencil stick adhesive, to form a two-layer laminate 16.

Figure 9:
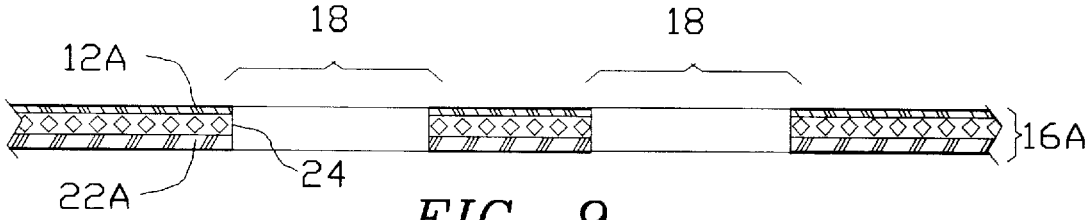

FIG. 9 shows the laminate 16 of FIG. 8 with regions 18 cut away through both layers to form a laminated stencil 16A.

Figure 10:
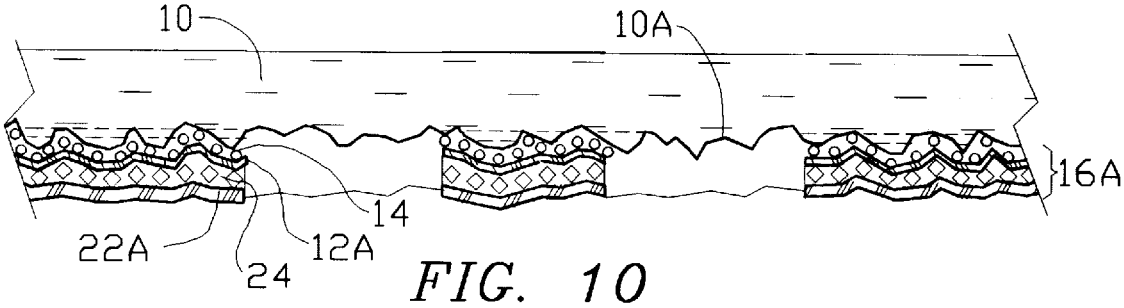

FIG. 10 shows the laminate stencil 16A attached to the textured surface 10A of ceiling 10, using a non-setting adhesive 14 applied to either the textured surface 10A or the compliant layer 12A and urging the laminated stencil 16A into conformity with the textured surface 10A in the same manner as described in connection with FIGS. 3 and 4.

With the laminated stencil 16A attached in place, the backing layer 22A is then removed. It is preferable that the backing layer 22 be made of a liquid-previous material such as kraft paper or brown masking paper, so that removal can be facilitated by saturating it with a liquid spray of water or a solvent so as to release the laminating adhesive.

With the backing layer 22A removed, the compliant stencil 12A will be exposed in place as in FIG. 4. At this point the compliant stencil 12A is further rolled and/or pressed into good compliance with the textured surface 10A, ready for the completion of the basic process as described above in connection with FIGS. 5–6A.

Figure 11:
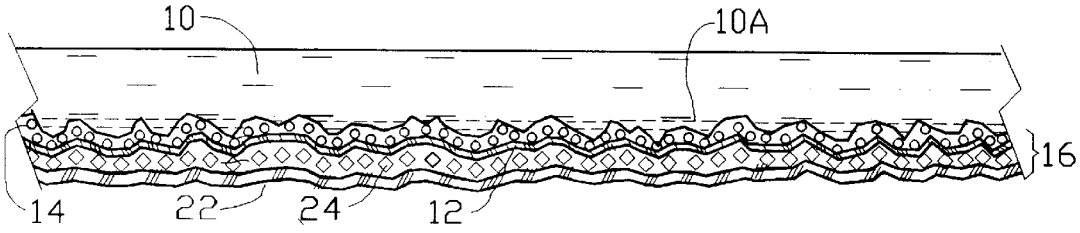
FIG. 11 shows, as an alternative, a laminate, as in FIG. 8, attached to a textured ceiling prior to cutting out the stencil pattern.

FIG. 11 shows an alternative preliminary process in which the laminate 16, as in FIG. 8, is first attached to the textured surface 10A of a ceiling 10 using non-setting adhesive 14, after which the stencil pattern is cut away from both layers yielding the structural stage shown in FIG. 10, to be further processed in the normal manner for the invention as described in connection with FIGS. 10 and then the process is completed in the normal manner as described in connection with FIGS. 4–6B.

Figure 12A:
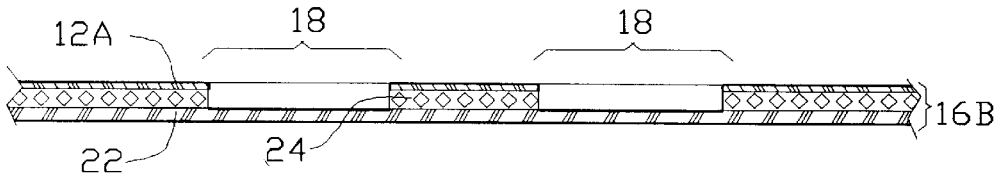
FIG. 12A shows, as another alternative, a fully-backed stencil with the pattern cut away from only the compliant layer, leaving the backing layer uncut.

FIG. 12A shows another alternative preliminary process in which the stencil pattern is cut into the compliant stencil 12A using a heat-type stencil cutter to cut only through the compliant layer 12A, removing the cut-out pieces while leaving the backing layer 22 uncut, thus forming a backed compliant stencil 16B in which the compliant stencil layer 12A remains supported by the backing layer 22 in original uncut form.

Figure 12B:
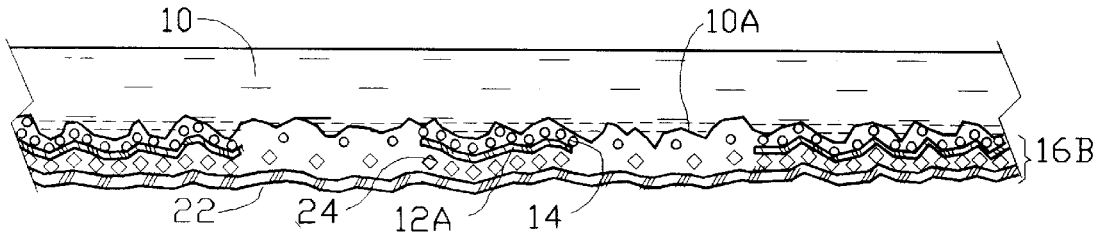
FIG. 12B shows the fully-backed stencil of FIG. 12A attached to a textured ceiling.

FIG. 12B shows the backed compliant stencil 16B of FIG. 12A attached to the textured surface 10A of a ceiling 10 using non-setting adhesive 14, applied either to the compliant layer 12A or to the textured surface 10A. The backed compliant stencil 16B is deployed in the same manner as described above in connection with FIG. 10: removing the backing layer 22, typically using liquid spray as described, and then completing the process in the normal manner as described in connection with FIGS. 4–6B.

As an alternative to initially removing the cut-out regions of the compliant layer 12A as described in the previous paragraph, these regions could be left in place until after attachment to the ceiling, then removed along with the backing layer 22 before completing the process in the usual manner described above.

Still another alternative preliminary process would be to utilize a total of three layers by adding a second backing layer, attached to the first backing layer with non-setting adhesive, in order to provide additional support that could be beneficial under particular conditions, e.g. for a particularly open or complex stencil pattern.

Practice of the invention is not limited to any particular textured surfaces such as those of interior walls and ceilings, nor is it limited to any particular portion of a surface such as the ceiling border shown as an illustrative example: it could include the whole surface of a ceiling and/or walls or any portion thereof.

With regard to the compliant material for the stencil, while clear transparent material is most readily available, and can be used in practice of the invention, the step of applying the embossing material may be facilitated if this is made opaque, e.g. colored or darkened, either as procured or possibly spray-coated after procurement, so as to constrast with the typically white surrounding textured surface.

The embossed regions may be made to have any special surface finish, texture and/or color, which may be selected to provide decorative contrast with the remaining exposed regions of the textured surface.

In addition to practice of the process of the invention as a trade or skill, it is contemplated that certain key elements or combinations thereof may marketed as do-it-yourself kits or as products in the architectural/building trades: for example the two layer laminate held together by non-setting adhesive, with or without stencil cutouts. This concept includes as peripherals the marketing of various stencil patterns and instruction materials.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A method of applying a decorative pattern in embossed form onto a predetermined region of an existing textured surface, comprising the steps of:

(a) attaching a thin sheet of compliant material to the predetermined region of the textured surface, utilizing therebetween a non-setting support adhesive;

(b) cutting away portions of the thin sheet of compliant material so as to form a compliant stencil with openings configured in accordance with the decorative pattern;

(c) urging the compliant stencil into intimate conforming contact with the textured surface, particularly around edges of the openings;

(d) applying a layer of a setting-type embossing material onto the textured surface in the stencil openings and extending as surplus onto the compliant stencil; and (e) peeling off the compliant stencil, including surplus embossing material, from the textured surface, leaving the layer of embossing material to set and bond in the predetermined regions, thus constituting the decorative pattern in embossed form.

2. The method of applying a decorative pattern as defined in claim 1 wherein step (a) further comprises the preliminary substep of:

(a-1) coating a surface of the thin sheet of compliant layer with the non-setting support adhesive.

3. The method of applying a decorative pattern as defined in claim 1 wherein step (a) further comprises the preliminary substep of:

(a-1) coating the predetermined region of the textured surface with the non-setting support adhesive.

4. The method of applying a decorative pattern as defined in claim 1 wherein step (d) further comprises the subsequent substep of:

(d1) troweling the embossing material to a desired thickness and surface smoothness.

5. A method of applying a decorative pattern in embossed form onto a predetermined region of an existing textured surface, comprising the steps of:

(a) attaching a thin compliant layer to a backing layer, relatively firmer than the compliant layer, with a non-setting laminating adhesive having a predetermined low adhesion strength, thus forming a two-layer laminate with the compliant layer and the backing layer each having an exposed surface;

(b) cutting away portions of the laminate so as to form a laminated stencil with openings configured in accordance with the decorative pattern;

(c) attaching the laminated stencil to the existing textured surface utilizing a non-setting adhesive interfacing the textured surface and the compliant layer;

(d) delaminating the laminate by peeling off the backing layer so as to leave the compliant layer forming a compliant stencil adhered to the textured surface;

(e) urging the compliant stencil into intimate conforming contact with the textured surface, particularly around edges of the stencil openings;

(f) applying a layer of a setting-type embossing material onto the textured surface in the stencil openings and extending onto the compliant stencil; and (g) peeling off the compliant stencil from the textured surface, leaving the layer of embossing material to set and bond in the predetermined regions, thus constituting the decorative pattern in embossed form.

6. The method of applying a decorative pattern as defined in claim 5 wherein the existing textured surface is that of an existing rough-textured ceiling and wherein the setting-type embossing material is a gypsum type joint compound that is compatible for bonding with the textured surface of the ceiling.

7. The method of applying a decorative pattern as defined in claim 5 wherein step (f) further comprises the subsequent substep of:

(f1) troweling the setting-type material to a desired thickness and surface smoothness.

8. The method of applying a decorative pattern as defined in claim 5 wherein:

the backing layer is made from liquid-pervious material;

the laminating adhesive is of a type such that its adhesion can be disabled by applying a liquid release agent; and step (d) further comprises the preliminary substep of (d-1) applying the liquid release agent in a manner to penetrate the backing layer and thus disable adhesion of the laminating adhesive and facilitate de-lamination.

9. The method of applying a decorative pattern as defined in claim 5 wherein step (a) further includes cutting the two-layer laminate into a plurality of pieces of a predetermined working size and shape, and wherein steps (c) through (g) are repeated for successive adjacent regions of the textured surface as required for completion of the decorative pattern.

10. The method of applying a decorative pattern as defined in claim 5 wherein, in step (b), both the compliant layer and the backing layer are cut away together in the regions of the stencil openings, so as to form a two-layer laminated stencil.

11. The method of applying a decorative pattern as defined in claim 5 wherein, in step (b), only the compliant layer is cut away in the regions of the stencil openings, so as to form a single-layer compliant stencil attached by non-setting adhesive to the backing layer which remains in original uncut form.

12. A method of applying a decorative pattern in embossed form onto an existing textured surface, comprising the steps of:

(a) attaching a thin compliant layer to a backing layer, relatively firmer than the compliant layer, with a temporary laminating adhesive having a predetermined low adhesion strength, thus forming a two-layer laminate with the compliant layer and the backing layer each having an exposed surface;

(b) attaching the laminate to the existing textured surface utilizing a non-setting adhesive interfacing the textured surface and the compliant layer;

(c) cutting away predetermined regions of the laminate so as to form stencil openings configured in accordance with the decorative pattern;

(d) delaminating the laminated stencil by peeling off the backing layer so as to leave the compliant layer as a stencil adhered to the textured surface;

(e) pressing the compliant layer into intimate conforming contact with the textured surface, particularly around edges of the stencil openings;

(f) applying a layer of a setting-type embossing material onto the textured surface in the stencil openings; and (g) peeling off the compliant stencil layer from the textured surface, leaving the layer of embossing material to set in the predetermined regions, thus constituting the desired decorative pattern in embossed form.

13. The method of applying a decorative pattern as defined in claim 12 wherein the textured surface is that of an existing rough-textured ceiling and wherein the setting-type embossing material is a gypsum type joint compound that is compatible for bonding with the rough textured surface of the ceiling.

14. The method of applying a decorative pattern as defined in claim 12 wherein step (b) further comprises the preliminary substep of:

(b-1) coating the exposed surface of the compliant layer with a non-setting support adhesive.

15. The method of applying a decorative pattern as defined in claim 12 wherein step (b) further comprises the preliminary substep of:

(b-1) coating a predetermined region of the textured surface with a non-setting support adhesive.

16. The method of applying a decorative pattern as defined in claim 12 wherein the backing layer is made from liquid-pervious material;

the laminating adhesive is of a type such that its adhesion can be disabled by applying a liquid release agent; and step (d) further comprises the preliminary sub-step of (d-1) applying the liquid release agent in a manner to penetrate the backing layer and thus disable adhesion of the laminating adhesive and facilitate de-lamination.

* * * * *